US010697677B2

(12) United States Patent
Yanachi et al.

(10) Patent No.: US 10,697,677 B2
(45) Date of Patent: Jun. 30, 2020

(54) PLATE TYPE HEAT EXCHANGER AND REFRIGERATION CYCLE APPARATUS

(71) Applicant: Mitsubishi Electric Corporation, Tokyo (JP)

(72) Inventors: Satoru Yanachi, Tokyo (JP); Yohei Kato, Tokyo (JP); Shinichi Uchino, Tokyo (JP); Kohei Kasai, Tokyo (JP); Tomoyoshi Obayashi, Tokyo (JP); Kimitaka Kadowaki, Tokyo (JP); Tetsuji Saikusa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 129 days.

(21) Appl. No.: 15/767,247

(22) PCT Filed: Dec. 11, 2015

(86) PCT No.: PCT/JP2015/084854
§ 371 (c)(1),
(2) Date: Apr. 10, 2018

(87) PCT Pub. No.: WO2017/098668
PCT Pub. Date: Jun. 15, 2017

(65) Prior Publication Data

US 2019/0170412 A1 Jun. 6, 2019

(51) Int. Cl.
*F25B 43/00* (2006.01)
*F28F 19/01* (2006.01)
(Continued)

(52) U.S. Cl.
CPC ..... *F25B 43/00* (2013.01); *F25B 39/00* (2013.01); *F25B 39/04* (2013.01); *F28D 9/005* (2013.01);
(Continued)

(58) Field of Classification Search
CPC ..... F25B 39/04; F25B 43/00; F25B 39/00; F25B 30/02; F25B 2339/043;
(Continued)

(56) References Cited

U.S. PATENT DOCUMENTS 5,924,484 A * 7/1999 Andersson ..... F28F 3/083 165/167
6,164,371 A * 12/2000 Bertilsson ..... F28D 9/005 165/140
(Continued)

FOREIGN PATENT DOCUMENTS

CN 1997865 A 7/2007
CN 102016480 A 4/2011
(Continued)

OTHER PUBLICATIONS

International Search Report of the International Searching Authority dated Mar. 8, 2016 for the corresponding international application No. PCT/JP2015/084854 (and English translation).
(Continued)

*Primary Examiner* — Frantz F Jules
*Assistant Examiner* — Martha Tadesse
(74) *Attorney, Agent, or Firm* — Posz Law Group, PLC

(57) ABSTRACT

A plate heat exchanger includes a plate stack including a plurality of heat transfer plates stacked with each other. Each of the heat transfer plates includes a heat medium inflow hole serving as an inlet for a heat medium, a heat medium outflow hole serving as an outlet for the heat medium, a refrigerant inflow hole serving as an inlet for refrigerant, and a refrigerant outflow portion located below the refrigerant inflow hole and serving as an outlet for the refrigerant. The heat transfer plates define heat medium passages, through each of which the heat medium flowing from the heat medium inflow hole flows, and refrigerant passages, through
(Continued)

each of which the refrigerant flowing from the refrigerant inflow hole flows downward, arranged alternately with one another. Each of the heat medium passages and the refrigerant passages is defined between adjacent ones of the heat transfer plates.

8 Claims, 6 Drawing Sheets

(51) Int. Cl.

| | |
|---|---|
| ***F25B 39/00*** | (2006.01) |
| ***F25B 39/04*** | (2006.01) |
| ***F28D 9/00*** | (2006.01) |
| ***F28F 9/02*** | (2006.01) |
| *F28D 21/00* | (2006.01) |
| *F25B 30/02* | (2006.01) |

(52) U.S. Cl.
CPC ..... *F28F 9/026* (2013.01); *F28F 9/028* (2013.01); *F28F 9/0236* (2013.01); *F28F 9/0246* (2013.01); *F28F 9/0282* (2013.01); *F28F 19/01* (2013.01); *F25B 30/02* (2013.01); *F25B 2339/043* (2013.01); *F25B 2339/047* (2013.01); *F28D 2021/007* (2013.01); *F28F 2210/08* (2013.01)

(58) Field of Classification Search
CPC ..... F25B 2339/047; F28D 9/005; F28D 2021/007; Y10S 165/393; F28F 9/026; F28F 9/0236; F28F 9/028; F28F 9/0282; F28F 19/01; F28F 9/0246; F28F 2210/08; F28F 2225/04; F28F 2265/12; F28F 3/046
See application file for complete search history.

(56) References Cited

U.S. PATENT DOCUMENTS

| | | | | |
|---|---|---|---|---|
| 2005/0211421 | A1* | 9/2005 | Ekelund | F28D 9/005 165/114 |
| 2007/0227716 | A1* | 10/2007 | Dahlberg | F28D 9/005 165/167 |
| 2007/0261833 | A1* | 11/2007 | Yang | F28D 9/005 165/167 |
| 2010/0139311 | A1* | 6/2010 | Nagao | C10M 107/24 62/468 |
| 2011/0024097 | A1* | 2/2011 | Christensen | F28D 9/005 165/166 |
| 2011/0168371 | A1* | 7/2011 | Gustafsson | F28D 9/005 165/170 |
| 2014/0290921 | A1* | 10/2014 | Ito | F28F 3/046 165/166 |

FOREIGN PATENT DOCUMENTS

| | | | | | |
|---|---|---|---|---|---|
| EP | 1 054 225 | A1 | | 11/2000 | |
| EP | 2 562 490 | A1 | | 2/2013 | |
| FR | 2 870 588 | A1 | | 11/2005 | |
| JP | H08-075320 | A | | 3/1996 | |
| JP | 10300286 | A | * | 11/1998 | |
| JP | H10-300286 | A | | 11/1998 | |
| JP | 2010-032126 | A | | 2/2010 | |
| JP | 2011-226729 | A | | 11/2011 | |
| JP | 2011-247579 | A | | 12/2011 | |
| JP | 2011247579 | | * | 12/2011 | |
| JP | 2011247579 | A | * | 12/2011 | F28F 3/046 |
| WO | 2005/098334 | A1 | | 10/2005 | |
| WO | 2009/123517 | A1 | | 10/2009 | |

OTHER PUBLICATIONS

Extended European Search Report dated Dec. 3, 2018 issued in corresponding EP patent application No. 15910283.9.
Office Action dated May 5, 2019 issued in corresponding CN Patent Application No. 201580085277.1 (and English translation).

* cited by examiner

PLATE TYPE HEAT EXCHANGER AND REFRIGERATION CYCLE APPARATUS

CROSS REFERENCE TO RELATED APPLICATION

This application is a U.S. national stage application of International Application No. PCT/JP2015/084854, filed on Dec. 11, 2015, the contents of which are incorporated herein by reference.

TECHNICAL FIELD

The present invention relates to a plate heat exchanger that traps sludge and a refrigeration cycle apparatus that traps sludge.

BACKGROUND

Sludge contained in refrigerant circulating through a refrigeration cycle apparatus may cause, for example, wear of pipes, clogging of an expansion device, and failure of a compressor. For example, a related-art refrigeration cycle apparatus includes a strainer including a fibrous filter located in a refrigerant cycle path, through which refrigerant circulates, to capture sludge (refer to Patent Literature 1, for example).

PATENT LITERATURE

Patent Literature 1: Japanese Unexamined Patent Application Publication No. 2011-226729

Disadvantageously, such a configuration, in which the strainer is added to the refrigerant cycle path, of the related-art refrigeration cycle apparatus disclosed in Patent Literature 1 results in increased cost. Furthermore, the fibrous filter in the configuration described in Patent Literature 1 may be clogged with captured sludge, leading to obstruction to the circulation of the refrigerant.

SUMMARY

The present invention has been made in view of the above-described disadvantages. The present invention aims to provide a plate heat exchanger and a refrigeration cycle apparatus that are capable of trapping sludge contained in refrigerant with a simple configuration to reduce or eliminate the likelihood of clogging of a refrigerant circuit.

A plate heat exchanger according to an embodiment of the present invention includes a plate stack including a plurality of heat transfer plates stacked with each other, each of the heat transfer plates including a heat medium inflow hole serving as an inlet for a heat medium, a heat medium outflow hole serving as an outlet for the heat medium, a refrigerant inflow hole serving as an inlet for refrigerant, and a refrigerant outflow portion located below the refrigerant inflow hole and serving as an outlet for the refrigerant, the heat transfer plates defining a plurality of heat medium passages, through each of which the heat medium flowing from the heat medium inflow hole flows, and a plurality of refrigerant passages, through each of which the refrigerant flowing from the refrigerant inflow hole flows downward, each of the heat medium passages and the refrigerant passages being defined between adjacent ones of the heat transfer plates such that the heat medium passage and the refrigerant passage are arranged alternately with one another; and a refrigerant outlet nozzle attached to the plate stack and projecting from the plate stack along a stacking direction of the heat transfer plates, the refrigerant outlet nozzle being configured to let therethrough the refrigerant, leaving the refrigerant outflow portion, out of the plate stack, the refrigerant outlet nozzle including a projection projecting upward from an inner surface of the refrigerant outlet nozzle.

A refrigeration cycle apparatus according to an embodiment of the present invention includes a refrigerant circuit, through which refrigerant circulates, including a compressor, the refrigerant passages of the above-described plate heat exchanger, an expansion device, and an evaporator connected in a loop by refrigerant pipes. The apparatus further includes a heat medium circuit, through which a heat medium circulates, including a pump, the heat medium passages of the plate heat exchanger, and a load side heat exchanger connected in a loop by heat medium pipes. The plate heat exchanger functions as a condenser that condenses the refrigerant.

According to the embodiments of the present invention, the projection on the inner surface of the refrigerant outlet nozzle inhibits flow of sludge out of the plate heat exchanger. According to the embodiments of the present invention, therefore, sludge contained in the refrigerant can be trapped with a simple configuration, and the likelihood of clogging of the refrigerant circuit can be reduced or eliminated.

DETAILED DESCRIPTION

Figure 1:
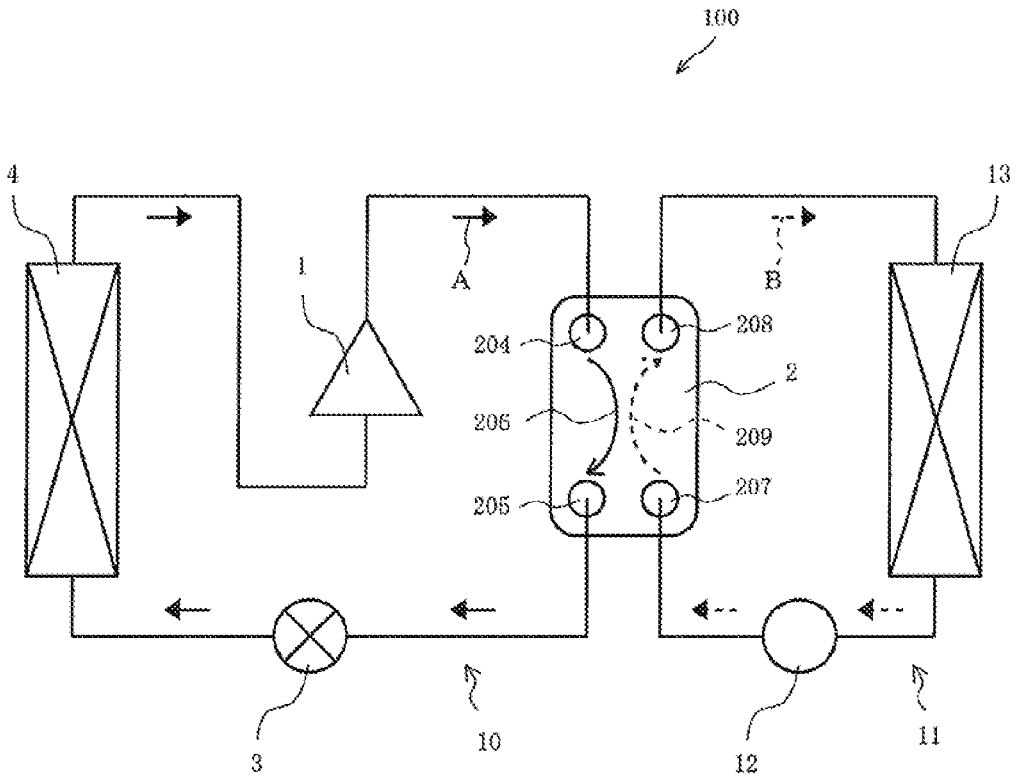
FIG. 1 is a schematic diagram illustrating an exemplary configuration of a refrigeration cycle apparatus according to Embodiment 1 of the present invention.

Embodiments of the present invention will be described below with reference to the drawings. In the drawings, the same components or equivalents are designated by the same reference signs, and a description thereof is omitted or simplified as appropriate. Furthermore, for example, the shapes, sizes, and arrangement of components illustrated in each drawing can be appropriately changed within the scope of the present invention.

Embodiment 1

[Refrigeration Cycle Apparatus]

FIG. 1 is a schematic diagram illustrating an exemplary configuration of a refrigeration cycle apparatus according to Embodiment 1 of the present invention. In FIG. 1, full-line arrows A indicate the direction of flow of refrigerant, and dotted-line arrows B indicate the direction of flow of a heat medium. A refrigeration cycle apparatus 100 according to Embodiment 1 includes a refrigerant circuit 10 and a heat medium circuit 11.

[Refrigerant Circuit]

The refrigerant circuit 10, through which refrigerant is circulated, includes a compressor 1, refrigerant passages 206 of a plate heat exchanger 2, an expansion device 3, and a heat source side heat exchanger 4, which are connected in a loop by refrigerant pipes. The refrigerant used in Embodiment 1 contains, as at least one component, a substance having a double bond in its molecule, such as HFO-1123, HFO-1234yf, or HFO-1234ze. Refrigerant containing no substance having a double bond may be used.

The compressor 1 compresses the refrigerant and is, for example, an inverter compressor that is capable of changing its operation frequency to any value to change a rate at which the refrigerant is sent per unit time. The plate heat exchanger 2 includes the refrigerant passages 206 through which the refrigerant flows and heat medium passages 209 through which the heat medium flows and allows the refrigerant flowing through the refrigerant passages 206 to exchange heat with the heat medium flowing through the heat medium passages 209. The expansion device 3 expands the refrigerant passing through the expansion device 3. For example, the expansion device 3 includes an expansion valve whose opening degree can be adjusted or a capillary tube having a simple configuration in which the opening degree cannot be adjusted. The heat source side heat exchanger 4 allows, for example, the refrigerant flowing through the heat source side heat exchanger 4 to exchange heat with air. For example, a fan (not illustrated) that sends the air to the heat source side heat exchanger 4 is disposed close to the heat source side heat exchanger 4.

[Operation of Refrigerant Circuit]

An exemplary operation of the refrigerant circuit 10 will now be described. High-temperature, high-pressure refrigerant compressed through the compressor 1 flows into the refrigerant passages 206 of the plate heat exchanger 2. The refrigerant that has flowed into the refrigerant passages 206 exchanges heat with the heat medium flowing through the heat medium passages 209, so that the refrigerant condenses. Specifically, the plate heat exchanger 2 in Embodiment 1 functions as a condenser that condenses the refrigerant. The refrigerant that has flowed through the refrigerant passages 206 and condensed is expanded by the expansion device 3. The refrigerant expanded by the expansion device 3 is subjected to heat exchange in the heat source side heat exchanger 4, so that the refrigerant evaporates. The refrigerant evaporated in the heat source side heat exchanger 4 is sucked into the compressor 1, where the refrigerant is again compressed.

[Heat Medium Circuit]

The heat medium circuit 11, through which the heat medium, such as water or brine, is circulated, includes a pump 12, the heat medium passages 209 of the plate heat exchanger 2, and a load side heat exchanger 13, which are connected in a loop by heat medium pipes. The pump 12 circulates the heat medium through the heat medium circuit 11. The load side heat exchanger 13 allows, for example, the heat medium flowing through the load side heat exchanger 13 to exchange heat with air. For example, a fan (not illustrated) that sends the air to the load side heat exchanger 13 is disposed close to the load side heat exchanger 13.

[Operation of Heat Medium Circuit]

An exemplary operation of the heat medium circuit 11 will now be described. The operation of the pump 12 causes the heat medium to be circulated through the heat medium circuit 11. The heat medium flowing through the heat medium passages 209 of the plate heat exchanger 2 exchanges heat with the refrigerant flowing through the refrigerant passages 206, so that the heat medium is heated. The heat medium that has flowed through the heat medium passages 209 and has been heated flows to the load side heat exchanger 13. The heat medium transfers heat to the air while flowing through the load side heat exchanger 13. Then, the heat medium flows through the heat medium passages 209 of the plate heat exchanger 2, so that the heat medium is again heated.

[Plate Type Heat Exchanger]

Figure 2:
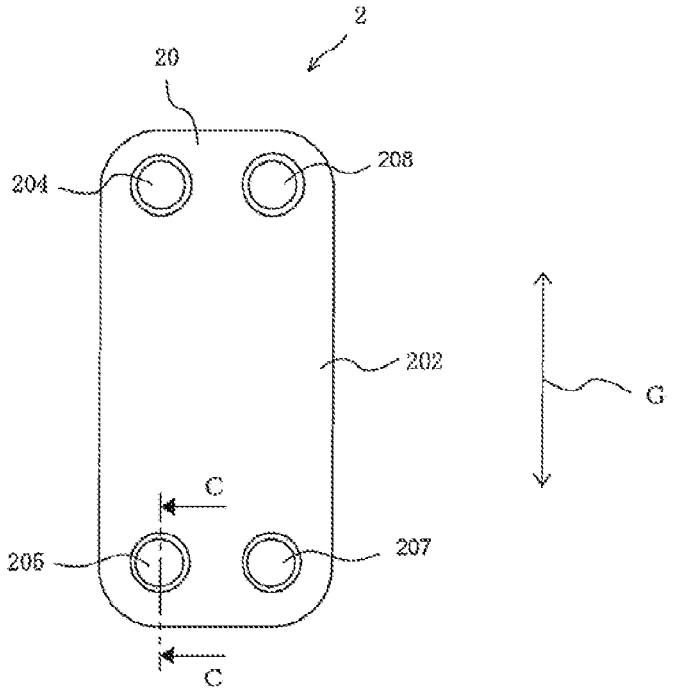
FIG. 2 is a schematic front view of a plate heat exchanger illustrated in FIG. 1.
Figure 3:
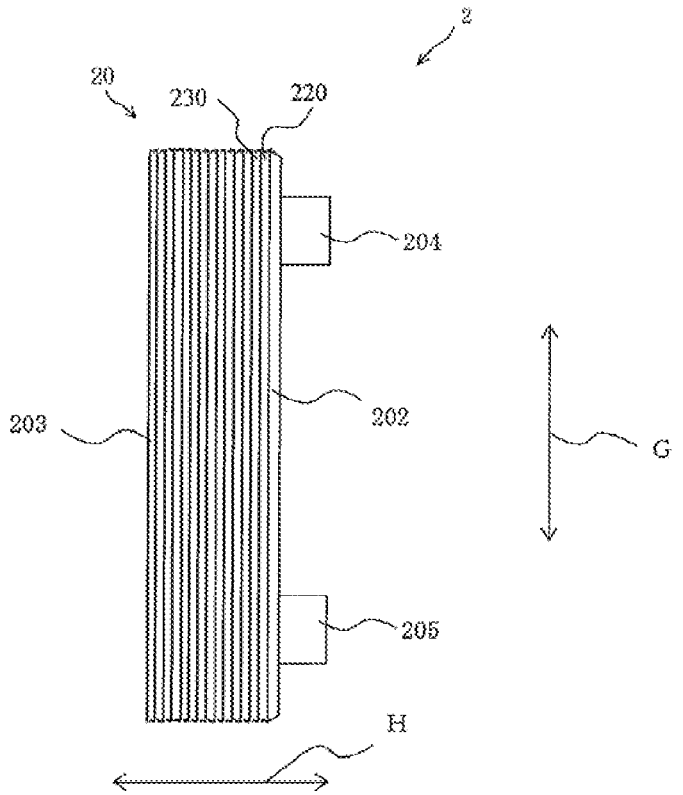
FIG. 3 is a schematic side elevation view of the plate heat exchanger illustrated in FIG. 2.
Figure 4:
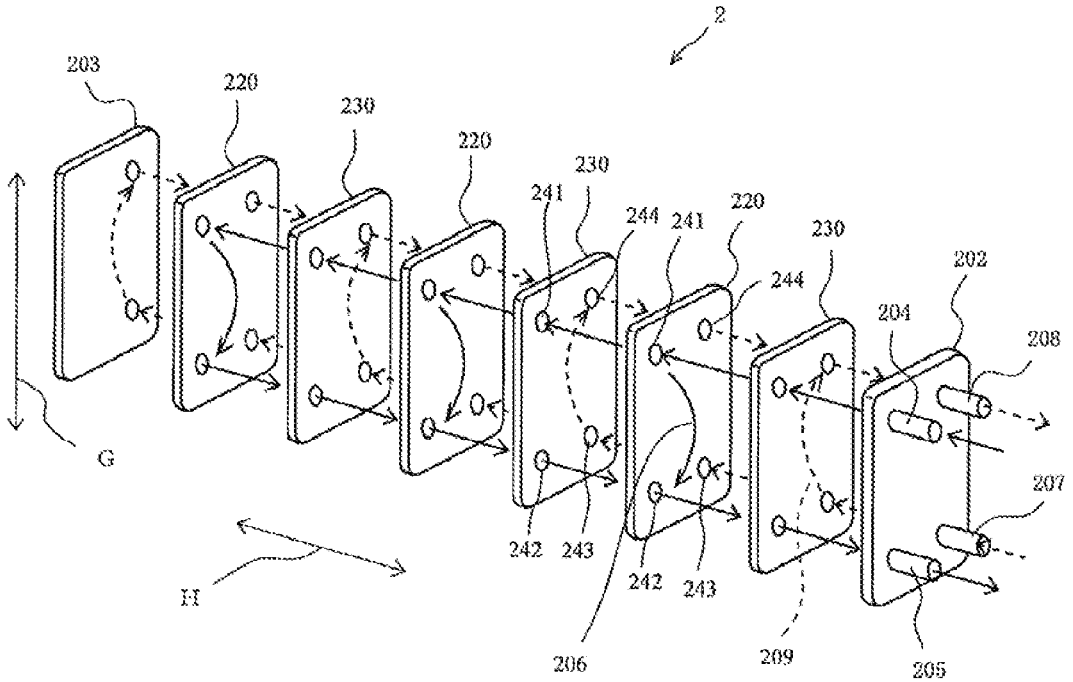
FIG. 4 is a schematic exploded perspective view of the plate heat exchanger illustrated in FIGS. 2 and 3.
Figure 5:
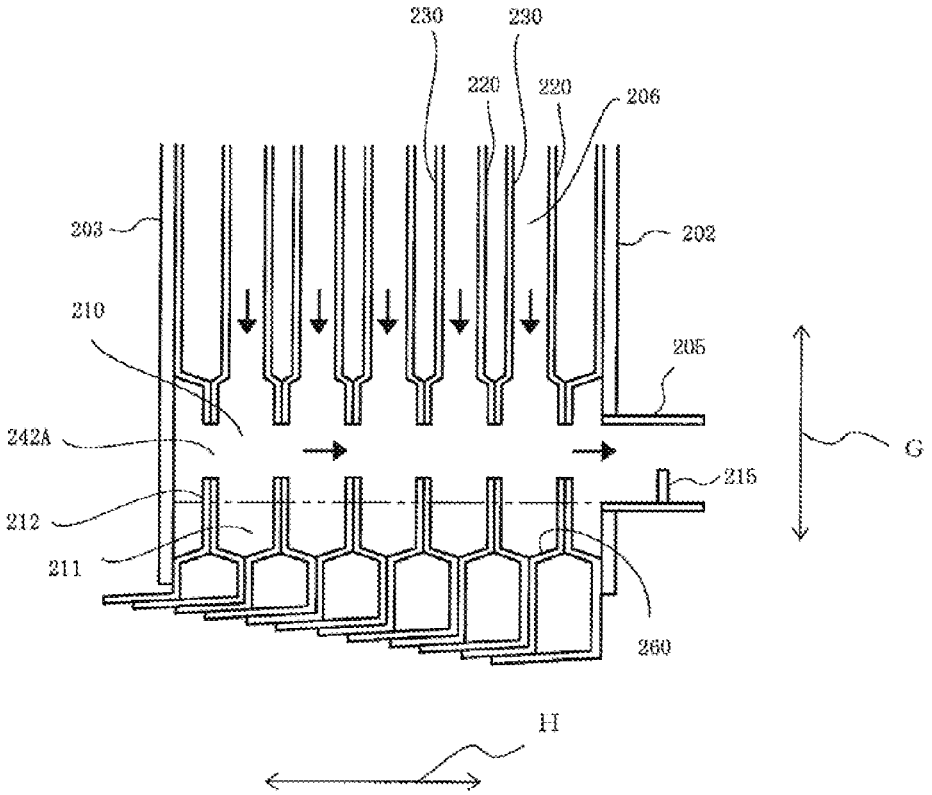
FIG. 5 is a schematic sectional view of the plate heat exchanger taken along a line C-C in FIG. 2.
Figure 6:
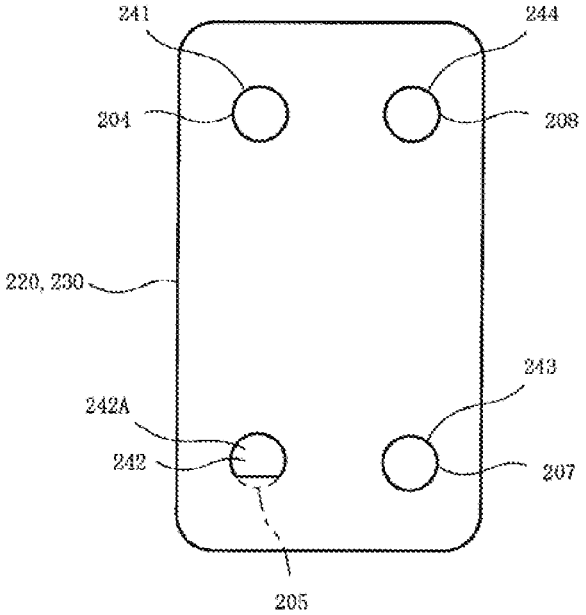
FIG. 6 is a schematic view of a heat transfer plate illustrated in FIG. 5.

FIG. 2 is a schematic front view of the plate heat exchanger illustrated in FIG. 1. FIG. 3 is a schematic side elevation view of the plate heat exchanger illustrated in FIG. 2. FIG. 4 is a schematic exploded perspective view of the plate heat exchanger illustrated in FIGS. 2 and 3. FIG. 5 is a schematic sectional view of the plate heat exchanger taken along a line C-C in FIG. 2. FIG. 6 is a schematic view of a heat transfer plate illustrated in FIG. 5. As illustrated in FIGS. 2 to 4, the plate heat exchanger 2 includes a plate stack 20, a refrigerant inlet nozzle 204, a refrigerant outlet nozzle 205, a heat medium inlet nozzle 207, and a heat medium outlet nozzle 208.

The plate stack 20 includes a front side plate 202, a rear side plate 203, heat transfer plates 220, and heat transfer plates 230 such that the heat transfer plates 220 and 230 are alternately stacked between the side plates 202 and 203. The side plate 202, the side plate 203, the heat transfer plates 220, and the heat transfer plates 230 are plate-shaped metals having, for example, a rectangular shape. The side plate 202, the side plate 203, the heat transfer plates 220, and the heat transfer plates 230 are joined at contacts by, for example, brazing. The side plate 202, the side plate 203, the heat transfer plates 220, and the heat transfer plates 230 are stacked, positioned, and brazed such that outer ends of the plates overlap as illustrated in FIG. 5, for example.

Referring to FIG. 4, the refrigerant passages 206, through which the refrigerant flows, alternate with the heat medium passages 209, through which the heat medium flows, such that each of the passages is defined between the adjacent joined plates. Embodiment 1 will be described with respect to an example in which the refrigerant flows downward as a downward flow through the refrigerant passages 206 and the heat medium flows upward as an upward flow through the heat medium passages 209. The plate heat exchanger 2 may be configured such that the refrigerant flows downward as a downward flow through the refrigerant passages 206 and the heat medium flows downward as a downward flow through the heat medium passages 209. The number of refrigerant passages 206 and the number of heat medium passages 209 are not limited to those illustrated in FIG. 4 and can be changed as appropriate in accordance with, for example, the specifications of the plate heat exchanger 2.

The heat transfer plates 220 and the heat transfer plates 230 are made by using, for example, different dies, and have different surface geometries. For the surface geometries of the heat transfer plates 220 and the heat transfer plates 230, for example, the heat transfer plates have a corrugated surface having corrugation depths varying in a stacking direction H in which the heat transfer plates 220 and 230 are stacked. The surface geometries cause the refrigerant flowing through the refrigerant passages 206 and the heat medium flowing through the heat medium passages 209 to flow in a complex manner, thus promoting heat exchange between the refrigerant and the heat medium.

Referring to FIGS. 2 and 4, the refrigerant inlet nozzle 204, the refrigerant outlet nozzle 205, the heat medium inlet nozzle 207, and the heat medium outlet nozzle 208 are attached to the side plate 202 of the plate stack 20. The refrigerant inlet nozzle 204, the refrigerant outlet nozzle 205, the heat medium inlet nozzle 207, and the heat medium outlet nozzle 208 are attached to the plate stack 20 such that the nozzles project from the plate stack 20 along the stacking direction H of the heat transfer plates 220 and 230. The refrigerant inlet nozzle 204 allows the refrigerant to enter the plate stack 20. The refrigerant inlet nozzle 204 is attached to, for example, upper left part of the side plate 202. The refrigerant outlet nozzle 205 lets the refrigerant out of the plate stack 20. The refrigerant outlet nozzle 205 is attached to lower left part of the side plate 202. The heat medium inlet nozzle 207 allows the heat medium to enter the plate stack 20. The heat medium inlet nozzle 207 is attached to lower right part of the side plate 202. The heat medium outlet nozzle 208 lets the heat medium out of the plate stack 20. The heat medium outlet nozzle 208 is attached to upper right part of the side plate 202. In the example of Embodiment 1, it is only required that the refrigerant outlet nozzle 205 is located below the refrigerant inlet nozzle 204. For example, at least one of the refrigerant inlet nozzle 204, the refrigerant outlet nozzle 205, the heat medium inlet nozzle 207, and the heat medium outlet nozzle 208 may be attached to the rear side plate 203 of the plate stack 20.

As illustrated in FIG. 4, the heat transfer plates 220 and the heat transfer plates 230 each include a refrigerant inflow hole 241, a refrigerant outflow portion 242, a heat medium inflow hole 243, and a heat medium outflow hole 244. The refrigerant inflow holes 241 are aligned to form a passage that allows an inflow of the refrigerant. The refrigerant inflow holes 241 are arranged so as to be aligned with the refrigerant inlet nozzle 204. The refrigerant flowing from the refrigerant inlet nozzle 204 passes through the passage formed by aligning the refrigerant inflow holes 241 and flows into the refrigerant passages 206. The heat medium inflow holes 243 are aligned to form a passage that allows an inflow of the heat medium. The heat medium inflow holes 243 are arranged so as to be aligned with the heat medium inlet nozzle 207. The heat medium flowing from the heat medium inlet nozzle 207 passes through the passage formed by aligning the heat medium inflow holes 243 and flows into the heat medium passages 209. The heat medium outflow holes 244 are aligned to form a passage that allows an outflow of the heat medium. The heat medium outflow holes 244 are arranged so as to be aligned with the heat medium outlet nozzle 208. The heat medium flowing from the heat medium passages 209 passes through the passage formed by aligning the heat medium outflow holes 244 and flows out of the refrigerant outlet nozzle 208.

The refrigerant outflow portions 242 are aligned to form a passage that allows an outflow of the refrigerant. The refrigerant outflow portions 242 are arranged so as to be aligned with the refrigerant outlet nozzle 205. As illustrated in FIG. 6, the refrigerant outflow portion 242 in Embodiment 1 is a refrigerant outflow hole 242A including arc-shaped upper part and linear, chord-like lower part. As illustrated in FIGS. 5 and 6, the lower part of the refrigerant outflow hole 242A is positioned above lower part of an inner surface of the refrigerant outlet nozzle 205. Referring to FIG. 5, the refrigerant outflow holes 242A are aligned to form a refrigerant outflow passage 210 that allows an outflow of the refrigerant. The refrigerant flowing from the refrigerant passages 206 passes through the refrigerant outflow passage 210 formed by aligning the refrigerant outflow holes 242A and flows out of the refrigerant outlet nozzle 205.

Referring to FIG. 5, in the example of Embodiment 1, the heat transfer plates 220 and the heat transfer plates 230 are subjected to drawing, for example. The heat transfer plates 220, the heat transfer plates 230, the side plate 202, and the side plate 203 are brought into contact with each other and joined, thus forming a bottom portion 260 that defines the bottoms of the refrigerant passages 206 and partitions 212 projecting upward from the bottom portion 260. The bottom portion 260 and the partitions 212 can be formed by, for example, drawing at least the heat transfer plates 220 or the heat transfer plates 230.

The bottom portion 260 is located below the lower part of the inner surface of the refrigerant outlet nozzle 205. The partitions 212 project above the lower part of the refrigerant outlet nozzle 205. The partitions 212 each have an upper end that defines part of the refrigerant outflow hole 242A. The refrigerant outflow hole 242A is located above the bottom portion 260. The partitions 212, the side plates 202 and 203, and the bottom portion 260 define spaces 211 such that adjacent ones of the partitions 212 define a space 211, the partition 212 and the side plate 202 define a space 211, and the partition 212 and the side plate 203 define a space 211.

The refrigerant outlet nozzle 205 includes a projection 215 projecting upward from its inner surface. For example, the projection 215 is formed of a separate from the refrigerant outlet nozzle 205. The projection 215 is fixed to the inner surface of the refrigerant outlet nozzle 205 by brazing, for example. The projection 215 can be formed integrally with the refrigerant outlet nozzle 205 by, for example, cutting the inner surface of the refrigerant outlet nozzle 205.

As described above, the plate heat exchanger 2 in the example of Embodiment 1 includes the plate stack 20 including the heat transfer plates 220 and 230 stacked. The heat transfer plates 220 and 230 define the refrigerant passages 206 and the heat medium passages 209 arranged alternately with one another such that each of the refrigerant passages 206 and the heat medium passages 209 is defined between the adjacent heat transfer plates 220 and 230. The refrigerant flowing downward through the refrigerant passages 206 in a gravity direction G exchanges heat with the heat medium flowing through the heat medium passages 209, so that the refrigerant condenses. The heat transfer plates 220 and 230 each have the refrigerant outflow hole 242A that allows the refrigerant to flow out of the refrigerant passage 206. The refrigerant that has flowed downward through the refrigerant passages 206 in the gravity direction G and condensed is redirected in the stacking direction H and flows substantially horizontally. The refrigerant flowing in the stacking direction H flows substantially horizontally through the refrigerant outflow passage 210, formed by aligning the refrigerant outflow holes 242A, and then flows out of the plate stack 20 through the refrigerant outlet nozzle 205. In the plate heat exchanger 2 in the example of Embodiment 1, the bottom portion 260 defining the bottoms of the refrigerant passages 206 is located below the lower parts of the refrigerant outflow holes 242A and the lower part of the inner surface of the refrigerant outlet nozzle 205. The spaces 211 are arranged below the refrigerant outflow holes 242A and the refrigerant outlet nozzle 205. In the plate heat exchanger 2 in the example of Embodiment 1, therefore, sludge can be efficiently trapped in the spaces 211. The reason is as follows. When the direction of flow of the refrigerant containing sludge is changed from the downward direction to the horizontal direction, the sludge is more likely to travel downward than the refrigerant because the sludge has greater mass than the refrigerant. Furthermore, the sludge sinks downward under the influence of gravity while the refrigerant containing the sludge is flowing substantially horizontally through the refrigerant outflow passage 210. In other words, the plate heat exchanger 2 in the example of Embodiment 1 uses inertial force and the gravity to efficiently trap the sludge in the spaces 211.

In addition, since the plate heat exchanger 2 in the example of Embodiment 1 includes the projection 215 projecting upward from the inner surface of the refrigerant outlet nozzle 205, this arrangement inhibits flow of the sludge out of the plate heat exchanger 2. In Embodiment 1, the projection 215 can be omitted.

Additionally, since the sludge is separated from the condensed liquid refrigerant and is trapped in the plate heat exchanger 2 in the example of Embodiment 1, the sludge can be efficiently trapped. The reason is that the liquid refrigerant flows at a lower velocity than gaseous refrigerant. Furthermore, the refrigerant flows in the plate heat exchanger 2 at a lower velocity than in another typical heat exchanger, such as a cross-fin type heat exchanger. Allowing the plate heat exchanger 2 to have a configuration for trapping sludge can efficiently trap the sludge.

In addition, the plate heat exchanger 2 in the example of Embodiment 1 is configured such that the refrigerant flows downward as a downward flow through the refrigerant passages 206 and the heat medium flows upward as an upward flow through the heat medium passages 209. Such a configuration increases the efficiency of heat exchange. Furthermore, this configuration ensures liquefaction of the refrigerant flowing out of the refrigerant passages 206. Consequently, the sludge can be trapped with certainty.

In the plate heat exchanger 2 in the example of Embodiment 1, the lower part of each refrigerant outflow hole 242A is positioned above the lower part of the inner surface of the refrigerant outlet nozzle 205. Therefore, the partitions 212 project above the lower part of the refrigerant outlet nozzle 205. The plate heat exchanger 2 in the example of Embodiment 1 is configured such that the sludge can be trapped between the partitions 212. Such a configuration reduces or eliminates the likelihood that the flow of the refrigerant may raise the sludge trapped in the spaces 211. Therefore, the plate heat exchanger 2 in Embodiment 1 inhibits the flow of the sludge out of the plate heat exchanger 2.

In the example of Embodiment 1, the spaces 211 for trapping sludge are arranged below the refrigerant outflow passage 210 and the refrigerant outlet nozzle 205. If sludge accumulates in the spaces 211, the refrigerant can flow through the refrigerant outflow passage 210 located above the spaces 211. This arrangement does not hinder the refrigerant from flowing.

If the refrigerant used in Embodiment 1 contains a substance having a double bond in its molecular structure, the above-described advantages will become more apparent. Specifically, a substance having a double bond may form a solid polymer. The circulation of refrigerant containing a solid polymer through the refrigerant circuit 10 may, for example, accelerate wear of the pipes, cause clogging of the expansion device 3, and accelerate wear of sliding parts of the compressor 1. According to Embodiment 1, if a solid polymer is formed, the solid polymer can be trapped in the spaces 211. This reduces or eliminates the likelihood that a formed solid polymer may cause failure of the refrigerant circuit 10.

The refrigeration cycle apparatus 100 in the example of Embodiment 1 is configured such that a polymer is trapped in the plate heat exchanger 2 that condenses high-temperature, high-pressure refrigerant discharged from the compressor 1. Such a configuration further reduces or eliminates the likelihood that a formed solid polymer may cause failure of the refrigerant circuit 10. The reason is as follows. A substance having a double bond tends to form a polymer, particularly under high-temperature and high-pressure conditions. In the example of Embodiment 1, a polymer can be trapped in the plate heat exchanger 2 that condenses high-temperature, high-pressure refrigerant discharged from the compressor 1. In other words, a polymer can be trapped immediately after the formation of the polymer in Embodiment 1, leading to enhanced reliability of the refrigeration cycle apparatus 100.

Embodiment 1 is not limited to the above-described example. Embodiment 1 includes the following modification. In the following description of the modification, a description of the previously described details is omitted.

[Modification 1]

Figure 7:
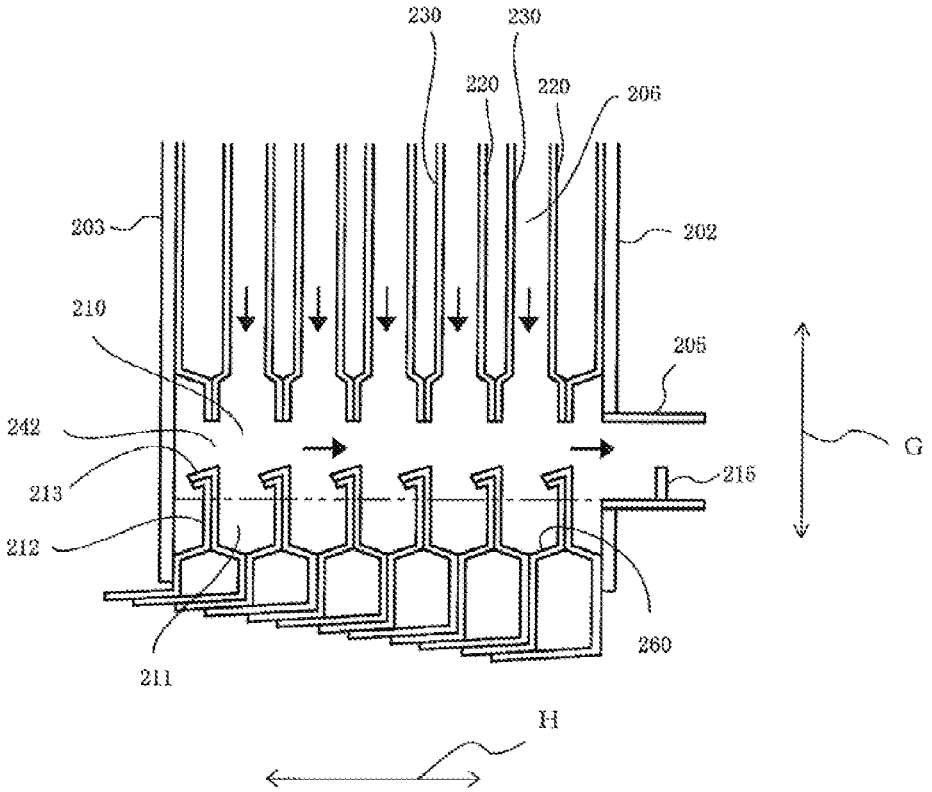
FIG. 7 is a schematic view of Modification 1 and illustrates a modification of a configuration illustrated in FIG. 5.

FIG. 7 is a schematic view of Modification 1 and illustrates a modification of a configuration of FIG. 5. As illustrated in FIG. 7, the partitions 212 in Modification 1 each include a bend 213. Specifically, the bend 213 is located below the refrigerant outflow portion 242. The bend 213 inhibits flow of sludge, trapped in the space 211, out of the space 211. It is only required that the bend 213 extends substantially in the stacking direction H, or toward any of the adjacent heat transfer plates. Extending the bend 213 toward the adjacent heat transfer plate located away from the refrigerant outlet nozzle 205 further reduces or eliminates the likelihood that the sludge may flow out of the space 211. As illustrated in FIG. 7, the bend 213 extending downward, or forming an acute angle with the partition 212 inhibits the flow of sludge with certainty. The bend 213 is formed by, for example, bending end part of the partition 212. The bend 213 can also be formed by fixing a separate to the partition 212. Although the heat transfer plates 220 and 230 each include the bend 213 in an example illustrated in FIG. 7, it is only required that at least one of the heat transfer plates includes the bend 213.

Embodiment 2

Figure 8:
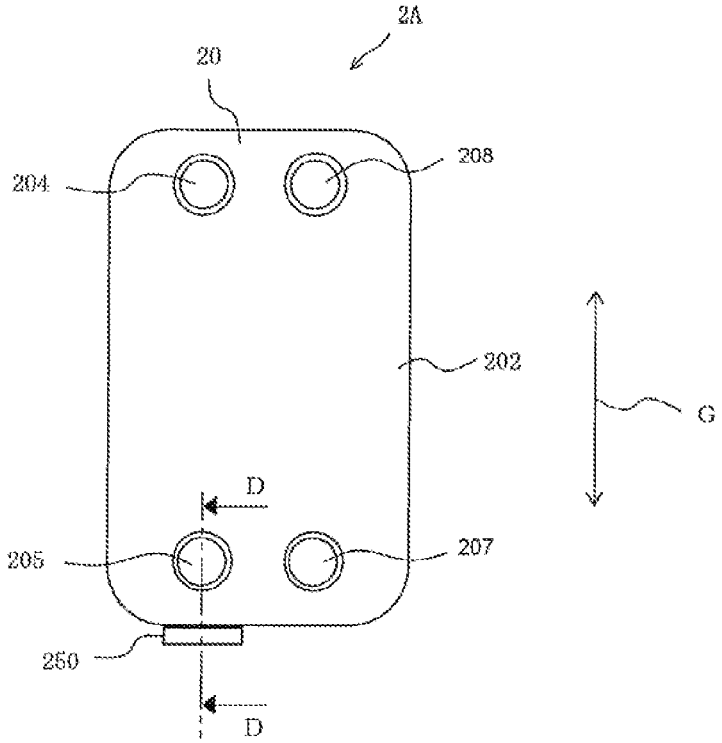
FIG. 8 is a schematic front view of a plate heat exchanger according to Embodiment 2 of the present invention.
Figure 9:
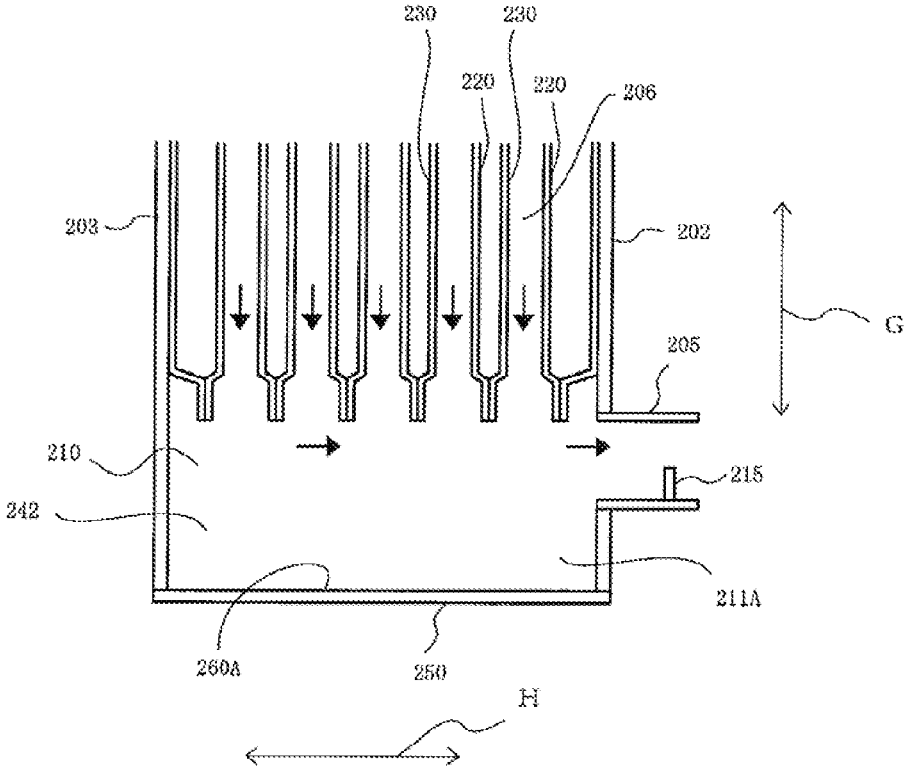
FIG. 9 is a schematic sectional view of the plate heat exchanger taken along a line D-D in FIG. 8.
Figure 10:
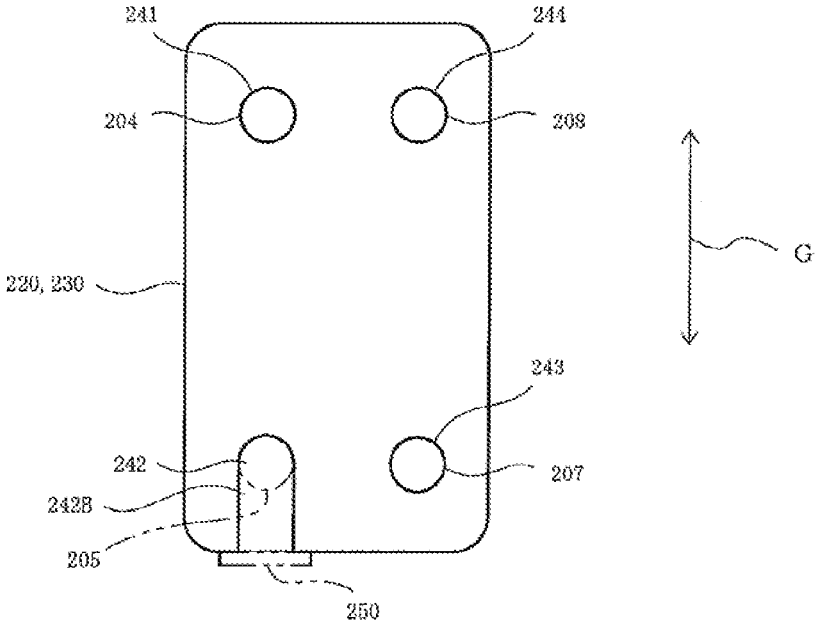
FIG. 10 is a schematic view of a heat transfer plate forming a section illustrated in FIG. 9.

FIG. 8 is a schematic front view of a plate heat exchanger according to Embodiment 2 of the present invention. FIG. 9 is a schematic sectional view of the plate heat exchanger taken along a line D-D in FIG. 8. FIG. 10 is a schematic view of a heat transfer plate forming a section illustrated in FIG. 9. In Embodiment 1 described above, the spaces 211 are separated by the partitions 212 as illustrated in FIG. 5. In Embodiment 2, a single space 211A continuously extending in the stacking direction H is provided between a front side plate 202 and a rear side plate 203. In the following description, the same components as those of the plate heat exchanger 2 according to Embodiment 1 are designated by the same reference signs and a description of these components is omitted or simplified.

As illustrated in FIGS. 8 to 10, a plate heat exchanger 2A in an example of Embodiment 2 includes heat transfer plates 220 and 230 each having a cut 242B, serving as a notch in lower part of the plate. A cover 250 is attached to a plate stack 20. The cover 250 covers the cuts 242B, thus forming a bottom portion 260A for refrigerant passages 206. In Embodiment 2, a refrigerant outflow portion 242 includes the cut 242B and the cover 250. The bottom portion 260A for the refrigerant passages 206 is located below lower part of an inner surface of a refrigerant outlet nozzle 205. In the plate heat exchanger 2A in the example of Embodiment 2, the space 211A for trapping sludge is increased in size. In addition, each of the refrigerant outflow portions 242 in the plate heat exchanger 2A according to Embodiment 2 is increased in cross-sectional area, so that the refrigerant flows through the refrigerant outflow portions 242 at a lower velocity. Therefore, the plate heat exchanger 2A according to Embodiment 2 can efficiently trap refrigerant.

Embodiment 2 is not limited to the above-described example. For example, Embodiment 2 includes the following modifications. In the following description of the modifications, a description of the previously described details is omitted.

[Modification 2]

Figure 11:
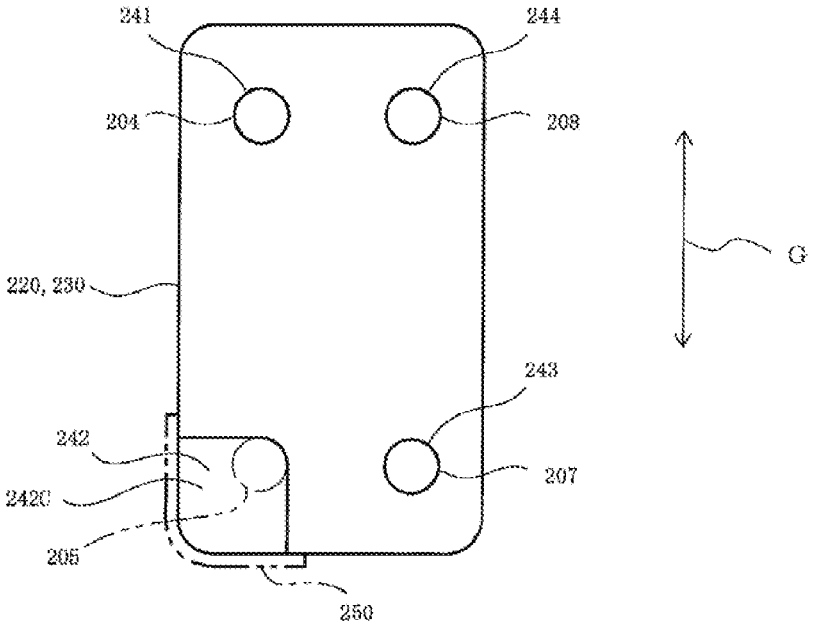
FIG. 11 is a schematic view of Modification 2 and illustrates a modification of a configuration of FIG. 10.

FIG. 11 is a schematic view of Modification 2 and illustrates a modification of a configuration of FIG. 10. As illustrated in FIG. 11, the heat transfer plates 220 and 230 in Modification 2 each have a cut 242C located in an area including lower part and side part of the plate. Such a configuration according to Modification 2 enables both a further increase in space 211A and a further increase in cross-sectional area of the refrigerant outflow portion 242.

[Modification 3]

Figure 12:
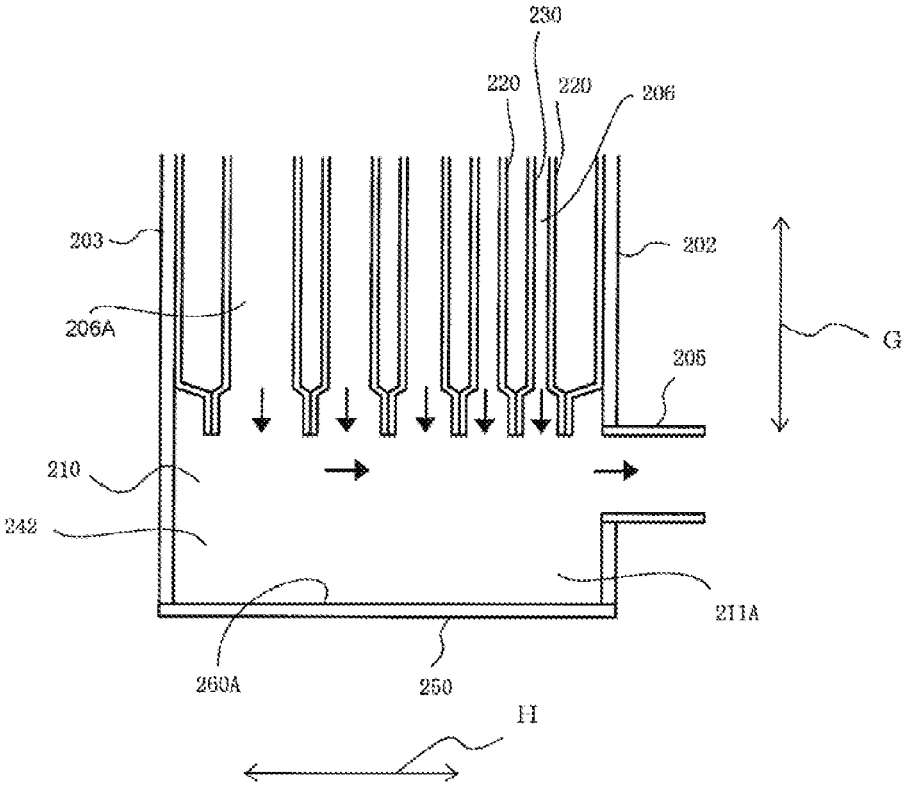
FIG. 12 is a schematic view of Modification 3 and illustrates a modification of a configuration of FIG. 9.

FIG. 12 is a schematic view of Modification 3 and illustrates a modification of a configuration of FIG. 9. As illustrated in FIG. 12, according to Modification 3, the refrigerant passage 206 located more away from the refrigerant outlet nozzle 205 has a greater width than the refrigerant passage 206 located closer to the refrigerant outlet nozzle 205. The refrigerant flows through the refrigerant passage 206 located more away from the refrigerant outlet nozzle 205 at a greater flow rate. Consequently, the refrigerant flows through a refrigerant passage 206A located more away from the refrigerant outlet nozzle 205 at a greater flow rate and then flows a longer distance through a refrigerant outflow passage 210, so that a polymer moving downward under the influence of gravity can be trapped. Such a configuration according to Modification 3 is particularly advantageous in a case where a large amount of polymer is formed. In the above description, adjusting the widths of the refrigerant passages 206 in the stacking direction H adjusts pressure loss to adjust the flow rate of refrigerant through the refrigerant passages 206. For example, adjusting the surface geometries of the heat transfer plates 220 and 230 can also adjust pressure loss.

The present invention is not limited to Embodiments 1 and 2 described above and can be variously modified within the scope of the invention. Specifically, the configurations according to Embodiments 1 and 2 described above may be appropriately modified and an equivalent may be substituted for at least one element thereof. Furthermore, a component whose location is not particularly limited does not necessarily have to be disposed at the location described in Embodiment 1 or 2, and may be disposed at any location that enables the component to achieve its function.

For example, the heat transfer plates 220 and 230 each have the refrigerant outflow hole 242A in Embodiment 1 described with reference to FIG. 5, and the heat transfer plates 220 and 230 each have the cut 242B in Embodiment 2 described with reference to FIG. 9. The configuration in Embodiment 1 may be combined with the configuration in Embodiment 2. Specifically, the plate heat exchanger may be configured such that at least one heat transfer plate has the refrigerant outflow hole 242A or the cut 242B. The plate heat exchanger having such a configuration can provide the same advantages as those described above.

Furthermore, the design according to Modification 3 may be applied to the configuration of the plate heat exchanger 2 according to Embodiment 1 described with reference to FIG. 5. Specifically, the plate heat exchanger 2 according to Embodiment 1 may be configured such that the refrigerant passage 206 located more away from the refrigerant outlet nozzle 205 has a greater width than the refrigerant passage 206 located closer to the refrigerant outlet nozzle 205.

The example in which the plate heat exchanger functions as a condenser has been described. If the refrigerant circuit includes a flow switching device, such as a four-way valve, the direction of flow of the refrigerant can be changed to cause the plate heat exchanger to function as an evaporator. In the case where the plate heat exchanger is caused to function as an evaporator, for example, the refrigerant may be circulated through the compressor, the heat source side heat exchanger, the expansion device, and the refrigerant passages of the plate heat exchanger in that order.

The invention claimed is:

1. A plate heat exchanger comprising:

a plate stack including a plurality of heat transfer plates stacked with each other, each of the heat transfer plates including a heat medium inflow hole serving as an inlet for a heat medium, a heat medium outflow hole serving as an outlet for the heat medium, a refrigerant inflow hole serving as an inlet for refrigerant, and a refrigerant outflow hole located below the refrigerant inflow hole and serving as an outlet for the refrigerant, the heat transfer plates defining a plurality of heat medium passages, through each of which the heat medium flowing from the heat medium inflow hole flows, and a plurality of refrigerant passages, through each of which the refrigerant flowing from the refrigerant inflow hole flows downward, each of the plurality of heat medium passages and the plurality of refrigerant passages being defined between adjacent ones of the heat transfer plates such that a heat medium passage and a refrigerant passage are arranged alternately with one another; and a refrigerant outlet nozzle attached to the plate stack and projecting from the plate stack along a stacking direction of the heat transfer plates, the refrigerant outlet nozzle being configured to let therethrough the refrigerant, leaving the refrigerant outflow portion hole, out of the plate stack, a lower edge of the refrigerant outflow hole being located above a lower edge of the inner surface of the refrigerant outlet nozzle, the refrigerant outlet nozzle including a projection projecting upward from an inner surface of the refrigerant outlet nozzle.

2. The plate heat exchanger of claim 1, wherein the plate stack has a bend that is located at a lower portion of the plate stack, at least one heat transfer plate of the heat transfer plates having the bend, the bend projecting toward a heat transfer plate adjacent to the heat transfer plate to which the bend is provided.

3. The plate heat exchanger of claim 2, wherein the bend projects toward the heat transfer plate that is adjacent to one heat transfer plate, more away from the refrigerant outlet nozzle, of two heat transfer plates adjacent to the heat transfer plate to which the bend is provided.

4. The plate heat exchanger of claim 1, wherein the plate stack includes a cut provided to a lower portion of the plate stack and a cover covering the cut, wherein the cut and the cover are provided to at least one of the heat transfer plates, wherein the cover serves as part of a bottom portion for the plurality of refrigerant passages, and wherein the bottom portion for the plurality of refrigerant passages is located below the lower part of the inner surface of the refrigerant outlet nozzle.

5. A plate heat exchanger comprising:

a plate stack including a plurality of heat transfer plates stacked with each other, each of the heat transfer plates including a heat medium inflow hole serving as an inlet for a heat medium, a heat medium outflow hole serving as an outlet for the heat medium, a refrigerant inflow hole serving as an inlet for refrigerant, and a refrigerant outflow portion located below the refrigerant inflow hole and serving as an outlet for the refrigerant, the heat transfer plates defining a plurality of heat medium passages, through each of which the heat medium flowing from the heat medium inflow hole flows, and a plurality of refrigerant passages, through each of which the refrigerant flowing from the refrigerant inflow hole flows downward, each of the plurality of heat medium passages and the plurality of refrigerant passages being defined between adjacent ones of the heat transfer plates such that a heat medium passage and a refrigerant passage are arranged alternately with one another; and a refrigerant outlet nozzle attached to the plate stack and projecting from the plate stack along a stacking direction of the heat transfer plates, the refrigerant outlet nozzle being configured to let therethrough the refrigerant, leaving the refrigerant outflow portion, out of the plate stack, the plate stack including a cut provided to a lower portion of the plate stack and a cover covering the cut, the cut and the cover being provided to at least one of the heat transfer plates, the cover serving as at least part of a bottom portion for the plurality of refrigerant passages, the bottom portion for the plurality of refrigerant passages being located below a lower part of an inner surface of the refrigerant outlet nozzle.

6. A refrigeration cycle apparatus comprising:

a refrigerant circuit, through which refrigerant circulates, including a compressor, the plurality of refrigerant passages of the plate heat exchanger of claim 1, an expansion device, and an evaporator connected in a loop by refrigerant pipes; and a heat medium circuit, through which a heat medium circulates, including a pump, the plurality of heat medium passages of the plate heat exchanger, and a load side heat exchanger connected in a loop by heat medium pipes, the plate heat exchanger functioning as a condenser that condenses the refrigerant.

7. The refrigeration cycle apparatus of claim 6, wherein the refrigerant circulating through the refrigerant circuit contains a substance having a double bond.

8. A plate heat exchanger comprising:

a plate stack including a plurality of heat transfer plates stacked with each other, each of the heat transfer plates including a heat medium inflow hole serving as an inlet for a heat medium, a heat medium outflow hole serving as an outlet for the heat medium, a refrigerant inflow hole serving as an inlet for refrigerant, and a refrigerant outflow portion located below the refrigerant inflow hole and serving as an outlet for the refrigerant, the heat transfer plates defining a plurality of heat medium passages, through each of which the heat medium flowing from the heat medium inflow hole flows, and a plurality of refrigerant passages, through each of which the refrigerant flowing from the refrigerant inflow hole flows downward, each of the plurality of heat medium passages and the plurality of refrigerant passages being defined between adjacent ones of the heat transfer plates such that a heat medium passage and a refrigerant passage are arranged alternately with one another; and a refrigerant outlet nozzle attached to the plate stack and projecting from the plate stack along a stacking direction of the heat transfer plates, the refrigerant outlet nozzle being configured to let therethrough the refrigerant, leaving the refrigerant outflow portion, out of the plate stack, the refrigerant outlet nozzle including a projection projecting upward from an inner surface of the refrigerant outlet nozzle, the plurality of refrigerant flow passages including a first refrigerant flow passage and a second refrigerant flow passage, wherein a distance between the first refrigerant flow passage and the refrigerant outlet nozzle is larger than a distance between the second refrigerant flow passage and the refrigerant outlet nozzle, and a width of the first refrigerant flow passage is larger than a width of the second refrigerant flow passage.

* * * * *